US008327859B2

(12) United States Patent
Pastore

(10) Patent No.: US 8,327,859 B2
(45) Date of Patent: Dec. 11, 2012

(54) MASCARA APPLICATOR AND METHOD OF USE

(76) Inventor: Dijana Pastore, Palatine, IL (US)

( * ) Notice: Subject to any disclaimer, the term of this patent is extended or adjusted under 35 U.S.C. 154(b) by 282 days.

(21) Appl. No.: 12/871,680

(22) Filed: Aug. 30, 2010

(65) Prior Publication Data

US 2011/0048444 A1 Mar. 3, 2011

Related U.S. Application Data

(60) Provisional application No. 61/237,925, filed on Aug. 28, 2009.

(51) Int. Cl.
*A45D 40/26* (2006.01)

(52) U.S. Cl. ..... 132/218

(58) Field of Classification Search ..... 132/216–218, 132/318, 73–75.3; 401/262, 269, 118–119, 401/126–130
See application file for complete search history.

(56) References Cited

U.S. PATENT DOCUMENTS

2007/0123808 A1* 5/2007 Rhoades ..... 601/73
2011/0155162 A1* 6/2011 Arditty et al. ..... 132/200

* cited by examiner

*Primary Examiner* — Todd Manahan
*Assistant Examiner* — Brianne Kalach
(74) *Attorney, Agent, or Firm* — McAndrews, Held & Malloy, Ltd.

(57) ABSTRACT

A novel mascara applicator blows air over a user's eyelashes after mascara is applied, wherein brushing of the mascara as it dries results in the appearance of fuller and longer eyelashes. The mascara applicator includes a housing that houses a mascara tube and brush, a fan and a battery. The housing has a vent and is configured to form an air chamber between the housing and the mascara tube. The fan blows air through the air chamber and out of the top of the housing, which is directed at the user's eyelashes after mascara is applied with the brush. The blowing air in conjunction with the upward and outward action of the mascara brush produces fuller, longer, and 200% more dramatic eyelashes.

16 Claims, 4 Drawing Sheets

MASCARA APPLICATOR AND METHOD OF USE

RELATED APPLICATIONS

This application makes reference to, claims priority to, and claims the benefit of U.S. Provisional Patent Application Ser. No. 61/237,925, entitled "Mascara Applicator and Method of Use", filed Aug. 28, 2009, the complete subject matter of which is hereby incorporated herein by reference in its entirety.

FEDERALLY SPONSORED RESEARCH OR DEVELOPMENT

[Not Applicable]

MICROFICHE/COPYRIGHT REFERENCE

[Not Applicable]

BACKGROUND OF THE INVENTION

The present mascara applicator and method of use generally relates to the field of cosmetics. More specifically, the present mascara applicator and method of use relates to devices used to apply eye makeup, particularly mascara to eyelashes.

Mascara is typically applied to eyelashes in layers. However, mascara is a liquid. Thus, the person must wait between applications for the mascara to dry before applying the next layer. The person may flutter their eyelids in an attempt to speed the drying of the mascara, but this will likely take longer than desired. The mascara is then applied after the drying process.

The goal when applying mascara is to make a person's eyelashes appear fuller and longer than their natural lashes. Existing mascara products are marketed as making lashes appear thicker and fuller for various reasons. For example, some products are marketed as offering thicker and fuller lashes because of the composition of the mascara used. Others are marketed as using a two-step process where the first step supposedly will define and smooth the lashes, and the second step will then supposedly build the lash volume. Still other products are marketed as having superior brush applicators. For instance, some products employ a rotating or oscillating brush that will supposedly create longer looking lashes.

BRIEF SUMMARY OF THE INVENTION

The present mascara applicator provides dramatically fuller and longer eyelashes than existing methods. A fan is incorporated into the mascara applicator that may be used to blow air over a user's eyelashes after applying mascara. The airflow quickly dries the mascara on the eyelashes as the mascara brush moves outward and upward, which reduces the waiting time between applications of mascara and results in a uniformly thicker coating of mascara on the eyelashes. By repeating this process, the user will then enjoy longer, fuller, and up to 200% more dramatic eyelashes.

One embodiment of the mascara applicator comprises a housing, the housing having a top, a bottom, and a sidewall; a mascara reservoir, the mascara reservoir configured to be at least partly housed in the housing; a cap, the cap configured to sealingly attach to the mascara reservoir; a mascara brush, the mascara brush configured to fit within the mascara reservoir; a fan attached to the mascara applicator, the fan having a suction side and discharge side; a battery, the battery electrically connected to the fan; a switch, the switch configured to electrically connect the battery and the fan to operate the fan; an air chamber, the air chamber having a diameter; wherein the fan blows air through the air chamber and out of the housing near the top of the housing.

In some embodiments, the housing may be made of plastic. Some embodiments may include a battery access that covers the battery. The battery access may in turn include a vent for airflow to the fan.

A method of applying mascara to a user's eyelashes using a mascara applicator may include a the mascara applicator, the mascara applicator comprising a housing, a mascara reservoir; a cap, the cap configured to sealingly attach to the mascara reservoir, a mascara brush, the mascara brush configured to fit within the mascara reservoir, a mascara applicator fan, the fan attached to the housing, a switch, the switch configured to electrically connect the fan to a battery and operate the fan. The method may comprise: applying a light coat of mascara to the user's eyelashes using long, upward strokes of the mascara brush; operating the mascara applicator fan; and then directing airflow from the fan at the user's eyelashes to dry the mascara quickly Additional objects and advantages of the invention are set forth in, or will be apparent to those of ordinary skill in the art from the detailed description herein. Also, it should be further appreciated that modifications and variations to the specifically illustrated and discussed features or materials hereof may be practiced in various embodiments and uses of this invention without departing from the spirit and scope thereof, by virtue of present reference thereto. Such variations may include, but are not limited to, substitution of equivalent means and features or materials for those shown or discussed, and the functional or positional reversal of various parts, features or the like.

BRIEF DESCRIPTION OF SEVERAL VIEWS OF THE DRAWINGS

A full and enabling disclosure of the present invention, including the best mode thereof, directed to one of ordinary skill in the art, is set forth in the specification, which makes reference to the appended figures, in which.

Figure 1:
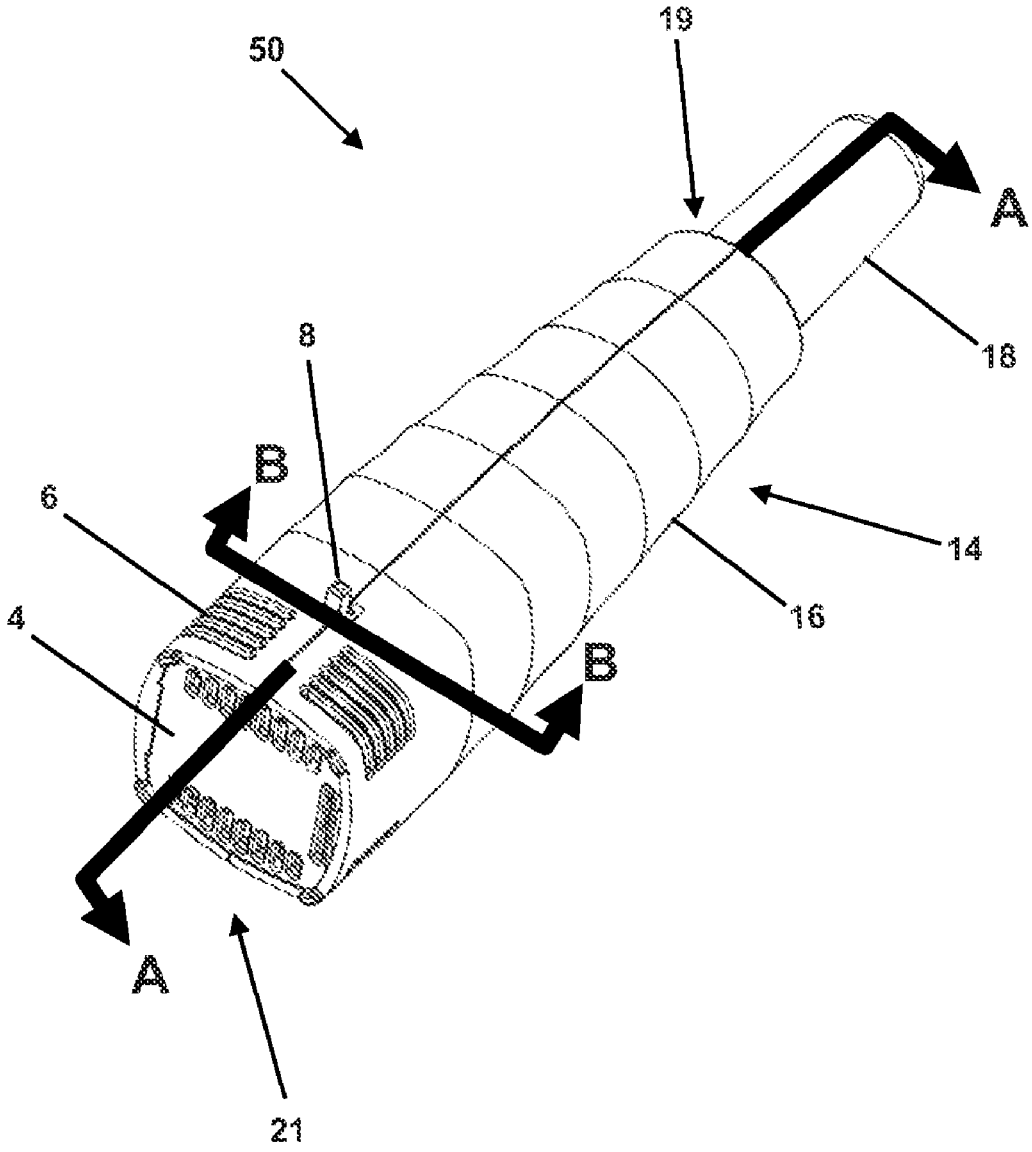
FIG. 1 is a perspective view of an embodiment of the present mascara applicator.

Repeat use of reference characters throughout the present specification and appended drawings is intended to represent same or analogous features or elements of the invention. While the present mascara applicator and method of use is amenable to various modifications and alternative forms, specifics thereof have been shown by way of example in the drawings and will be described in detail. It should be understood, however, that the intention is not to limit the invention to the particular embodiments described. On the contrary, the intention is to cover all modifications, equivalents, and alternatives falling within the spirit and scope of the invention.

DETAILED DESCRIPTION OF THE INVENTION

Reference now will be made in detail to the embodiments of the invention, one or more examples of which are set forth below. Each example is provided by way of explanation of the invention, not limitation of the invention. In fact, it will be apparent to those skilled in the art that various modifications and variations can be made in the present invention without departing from the scope or spirit of the invention. For instance, features illustrated or described as part of one embodiment, can be used on or with another embodiment to yield a still further embodiment. Thus, it is intended that the present invention cover such modifications and variations. Other objects, features and aspects of the present invention are disclosed in or are apparent from the following detailed description. It is to be understood by one of ordinary skill in the art that the present discussion is a description of exemplary embodiments only, and is not intended as limiting the broader aspects of the present invention.

Figure 4:
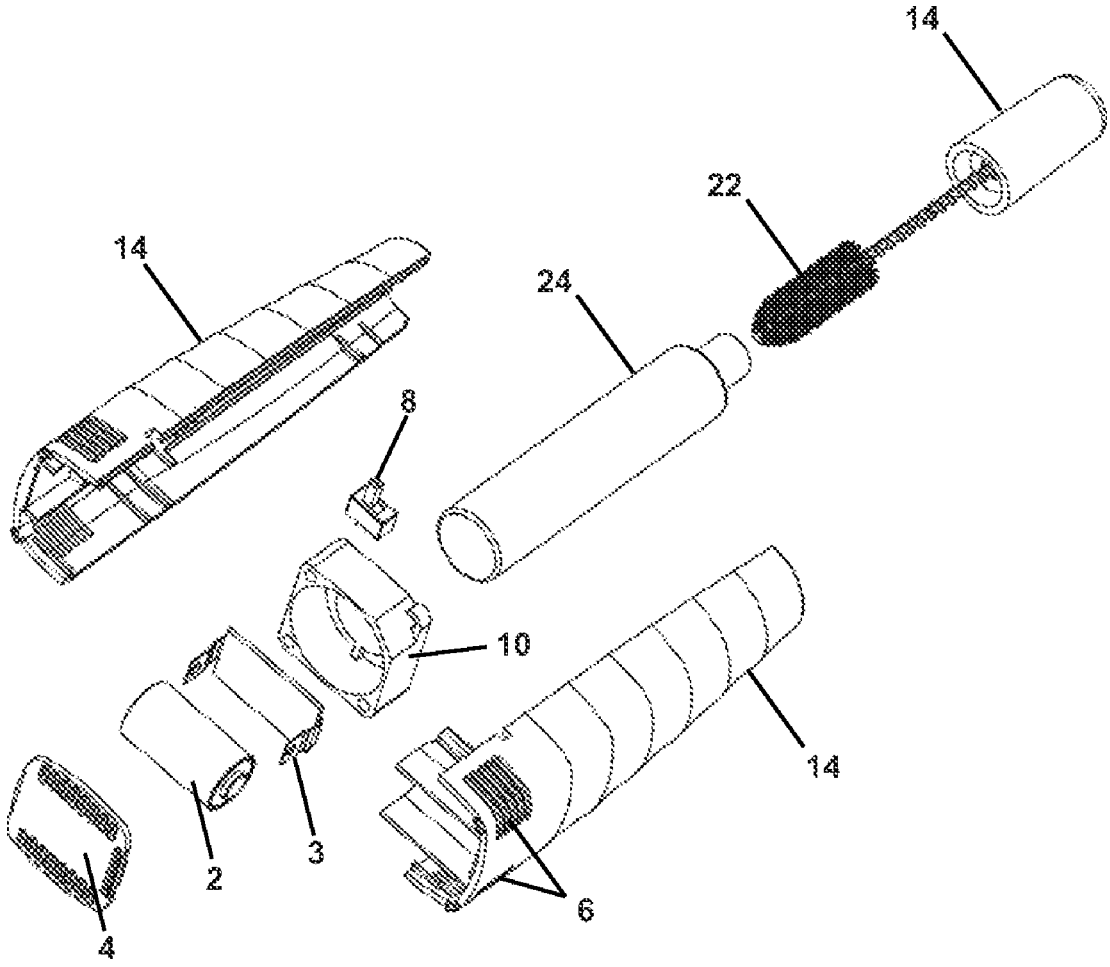
FIG. 4 is an exploded view of an embodiment of the mascara applicator.

FIG. 1 depicts a preferred embodiment of the present mascara applicator 50. Mascara applicator 50 includes a housing 14, which in this embodiment houses a mascara tube 24, a fan 10, and a battery 2 (these are best seen in FIG. 4). Housing 14 includes a top 19, bottom 21, and sidewall 16. Mascara tube 24 holds the liquid mascara. Cap 18 of mascara tube 24 is seen near the top 19 of housing 14. Battery 2 is located near the bottom 21 of housing 14. Housing 14 may have an ergonomic and or aesthetically pleasing shape. For example, housing 14 may be ribbed, stepped, grooved, etc. to provide an ergonomic and or aesthetically pleasing look, and include shapes that are cylindrical, cylindraceous, square, rectangular, etc. Housing 14 is assembled in two parts in this embodiment, but could also be manufactured as a single part (not shown). Housing 14 includes vents 6 through which air is drawn by fan 10. The location of the vents 6 is not critical. Vents 6 could easily be located elsewhere on the housing 14. Housing 14 is preferably made from a lightweight material, such as plastic.

Switch 8 activates fan 10 (best seen in FIG. 4). However, a variety of readily available switches may be used. For example, and not by way of limitation, while a single-pole sliding switch is depicted in this embodiment, the present mascara applicator and method of use may employ a variety of switch types, including a multiple pole switch enabling multiple fan speeds, or a push-button switch rather than a sliding switch.

Figure 2:
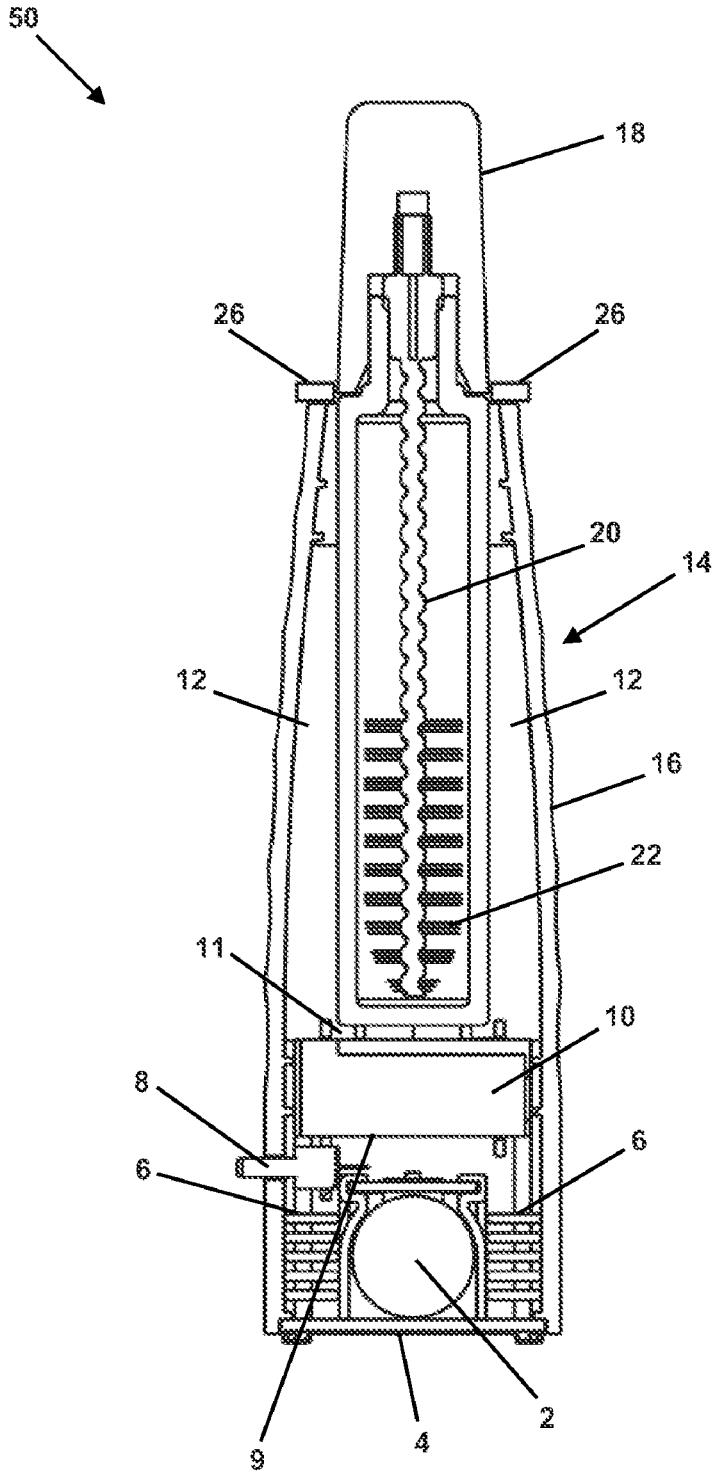
FIG. 2 is a sectional view of the mascara applicator of FIG. 1 along section A-A.
Figure 3:
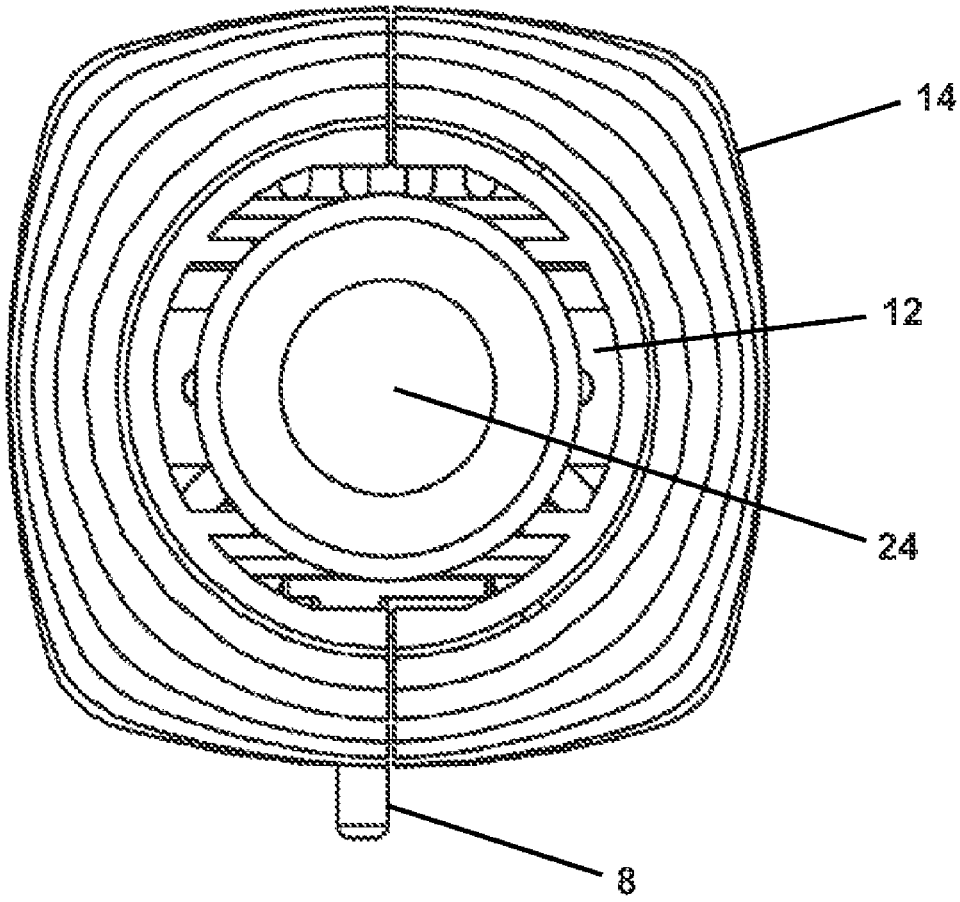
FIG. 3 is a sectional view of the mascara applicator of FIG. 1 along section B-B.

Turning now to FIGS. 2 and 3, fan 10 has a suction side 9 for drawing in air and a discharge side 11 for discharging air. A presently preferred fan is a 5V fan made by Sunon, part number GM0502PFV1-8, but other fans may also be used. Fan 10 is powered by battery 2. A presently preferred battery is the Energizer A544 alkaline battery, but other batteries may also be used. Battery access 4 is located near the bottom of housing 14, and covers battery 2. Alternatively, battery access 4 may be located elsewhere, such as on the side of housing 14 (not shown). Battery access may be secured to housing in a variety of ways, including the use of fasteners, such as screws, hinges, tabs, etc. Battery access 4 may also include vents. Air drawn through vents 6 in the housing and/or battery access may also serve to cool battery 2. Battery access 4 may also be omitted entirely. For instance, a multi-part housing may be used where battery 2 can be accessed by opening the multi-part housing. Battery access 4 may also be omitted where the device is intended to be disposable. Of course, battery 2 may be located outside the housing in a nearby attached compartment. In other embodiments, fan may be attached to the exterior of housing 14 (not shown), or to a removable cover (not shown) that mates with housing 14. In those embodiments, vents 6 may not be necessary.

A mascara reservoir in the form of mascara tube 24 may be fitted in housing 14 with an interference fit at the bottom of the housing 14 such that cap portion 18 of mascara tube 24 protrudes above housing 14. Alternatively, housing 14 may include a flexible sleeve (not shown) within or on top of housing 14 to accept and hold mascara tubes 24 of varying sizes. Users may then refill Mascara applicator 50 with mascara tubes 24 of various brands and manufacturers. Mascara applicator 50 may thus be reusable. Mascara applicator 50 may also be disposable, in which case mascara tube 24 may be of a non-standard size and configuration, and be fitted in housing 14 with a more secure arrangement, such as a snap-fit latch, c-ring collar, or the like (not shown).

Cap 18 may be attached to mascara brush 22 by stem 20. Alternatively, cap 18 may be separate from mascara brush 22, in which case mascara brush 22 may have a separate handle (not shown) configured to fit within cap 18. Mascara brush 22 is not limited to the size, thickness or shape shown in FIGS. 2 and 4. Bristles of the mascara brush 22, for example, may vary in size, shape, length and width.

Air chamber 12 may be formed between the sidewall 16 of mascara tube 24 and housing 14. In this embodiment, air chamber 12 decreases in size from the bottom of mascara tube 24 to the top. This provides accelerated airflow from the top of mascara applicator 50 when fan 10 is activated by switch 8 to ensure that the mascara applied to the user's eyelashes dries quickly, e.g. in one to two seconds versus six to ten seconds. However, air chamber 12 need not decrease in size if fan 10 is sized such that the airflow from the top of mascara applicator 50 is sufficient to quickly dry the mascara applied to the user's eyelashes. Air is drawn into fan 10 through vents 6 and past battery 2, and blown into air chamber 12. Battery access 4 covers battery 2, which is electrically connected to fan 10 through switch 8.

Cap 18 may be configured to cover air chamber 12 opening at the top of housing 14. For example, and not by way of limitation, FIG. 2 depicts an air chamber protector 26 that extends radially outward from cap 18 and covers air chamber 12 opening at the top of housing 14. Alternatively, the cap 18 may be configured to extend radially to cover air chamber 12 opening. Air chamber protector 26 is intended to prevent the entry of significant debris, such as lint, etc., into air chamber 12. FIG. 4 depicts an exploded view of mascara applicator 50. A two-piece housing 14 is configured to house mascara tube 24, fan 10, battery 2, and battery terminal 3. Housing 14 includes airflow vents 6. Battery access 4 is connected to housing 14 when the two halves of housing 14 are attached to each other. The two halves can be attached in a variety of ways, including a snap fit, fasteners, such as clips, screws, tabs, etc. Mascara cap 18 may be secured to mascara tube 24 with a threaded connection, although any readily removable, sealing connection will suffice. Stem 20 and mascara brush 22 are thereby enclosed in mascara tube 24. Of course, if mascara applicator is made disposable, mascara tube 24 may be replaced with a mascara reservoir (not shown) located in the housing 14.

In operation, mascara applicator 50 may be carried on the person of a user, e.g., in a purse or pocket, until used. When used to apply mascara, the user removes cap 18, which is attached to mascara brush 22 in this embodiment, and thus removes mascara brush 22 from mascara applicator 50. The user also operates switch 8 to activate fan 10. This is not done in any particular order, e.g. the user could activate fan 10 before removing cap 18. The user then applies a light coat of mascara to the user's eyelashes using long, upward strokes with the mascara brush 22. After mascara application, the user then directs airflow from mascara applicator 50 at the user's eyelashes to dry the mascara quickly. This will create a "false lash" look or fuller and longer-looking lashes, giving the user up to a 200% fuller lash look.

Although preferred embodiments of the invention have been described using specific terms, devices, and methods, such description is for illustrative purposes only. The words used are words of description rather than of limitation. It is to be understood that changes and variations may be made by those of ordinary skill in the art without departing from the spirit or the scope of the present invention, which is set forth in the following example claims. In addition, it should be understood that aspects of the various embodiments may be interchanged either in whole or in part. Therefore, the spirit and scope of the appended example claims should not be limited to the description of the preferred versions contained therein.

What is claimed is:

1. A mascara applicator comprising:

a housing, the housing having a top, a bottom, and a sidewall;

a mascara reservoir, the mascara reservoir configured to be at least partly housed in the housing;

a cap, the cap configured to sealingly attach to the mascara reservoir;

a mascara brush, the mascara brush configured to fit within the mascara reservoir;

a fan attached to the mascara applicator, the fan having a suction side and discharge side;

a battery, the battery electrically connected to the fan;

a switch, the switch configured to electrically connect the battery and the fan to operate the fan;

an air chamber, the air chamber having a diameter;

wherein the fan blows air through the air chamber and out of the housing near the top of the housing.

2. The mascara applicator of claim 1, wherein the mascara brush is connected to the cap.

3. The mascara applicator of claim 1, wherein the housing further comprises a battery access portion.

4. The mascara applicator of claim 3, wherein at least one vent includes a vent located on the battery access portion.

5. The mascara applicator of claim 1, wherein the housing is comprised of plastic.

6. The mascara applicator of claim 1, wherein the mascara reservoir is comprised of a mascara tube.

7. The mascara applicator of claim 1, wherein the fan is located in the housing.

8. The mascara applicator of claim 7, further comprising at least one vent in the housing, the at least one vent configured to allow airflow into the suction side of the fan.

9. A method of applying mascara to a user's eyelashes using a mascara applicator, the mascara applicator comprising a housing, a mascara reservoir; a cap, the cap configured to sealingly attach to the mascara reservoir, a mascara brush, the mascara brush configured to fit within the mascara reservoir, a mascara applicator fan, the fan attached to the housing, a switch, the switch configured to electrically connect the fan to a battery and operate the fan, the method comprising:

applying a light coat of mascara to the user's eyelashes using long, upward strokes of the mascara brush;

operating the mascara applicator fan; and then directing airflow from the fan at the user's eyelashes to dry the mascara quickly.

10. The method of applying mascara to eyelashes using a mascara applicator of claim 9, wherein the mascara brush is connected to the cap.

11. The method of applying mascara to eyelashes using a mascara applicator of claim 9, wherein the step of operating the fan further comprises activating a switch to electrically connect the battery with the fan.

12. The method of applying mascara to eyelashes using a mascara applicator of claim 11, wherein the mascara reservoir is a removable mascara tube.

13. The method of applying mascara to eyelashes using a mascara applicator of claim 9, wherein the housing is comprised of plastic.

14. The method of applying mascara to eyelashes using a mascara applicator of claim 9, wherein the fan is located within the housing.

15. The method of applying mascara to eyelashes using a mascara applicator of claim 14, wherein the housing further comprises at least one vent in the housing, the at least one vent configured to allow airflow into a suction side of the fan.

16. The method of applying mascara to eyelashes using a mascara applicator of claim 15, wherein the at least one vent includes a vent located on the battery access portion.

* * * * *